US005360460A

United States Patent [19]

Mozdzen et al.

[11] Patent Number: 5,360,460

[45] Date of Patent: Nov. 1, 1994

[54] COMPOSITION AND METHOD RELATING TO DIESEL POWERED VEHICLES

[75] Inventors: Edward C. Mozdzen, Willoughby; William B. Chamberlin, III, Kirtland; Barbara A. Saiter, Mentor, all of Ohio

[73] Assignee: The Lubrizol Corporation, Wickliffe, Ohio

[21] Appl. No.: 969,669

[22] Filed: Oct. 30, 1992

Related U.S. Application Data

[62] Division of Ser. No. 619,849, Nov. 29, 1990, Pat. No. 5,197,997.

[51] Int. Cl.[5] ..... C10L 1/18; C10L 1/22

[52] U.S. Cl. ..... 44/386; 44/434; 44/443

[58] Field of Search ..... 44/386, 434, 443

[56] References Cited

U.S. PATENT DOCUMENTS

| | | | |
|---|---|---|---|
| Re. 28,605 | 11/1975 | Alburger | 106/19 |
| Re. 32,174 | 6/1986 | LeSuer | 44/70 |
| 2,807,526 | 9/1957 | Foreman | 44/443 |
| 2,929,696 | 3/1960 | Barusch et al. | 44/66 |
| 2,984,550 | 5/1961 | Chamot | 44/415 |
| 3,311,479 | 3/1967 | Alburger | 106/19 |
| 3,687,644 | 8/1972 | Delafield et al. | 44/56 |
| 3,896,664 | 7/1975 | Alburger | 73/104 |
| 3,909,215 | 9/1975 | Kray | 44/62 |
| 4,128,403 | 12/1978 | Honnen | 44/71 |
| 4,198,306 | 4/1980 | Lewis | 252/51.5 |
| 4,237,022 | 12/1980 | Barrer | 252/51.5 |
| 4,409,000 | 10/1983 | LeSuer | 44/70 |
| 4,661,120 | 4/1987 | Carr et al. | 44/443 |
| 4,925,581 | 5/1990 | Erickson et al. | 252/48.2 |
| 4,956,107 | 9/1990 | Gutiersez et al. | 252/47 |
| 5,024,678 | 6/1991 | Mertone-Gettselig | 44/348 |
| 5,197,997 | 3/1993 | Mozdzen et al. | 44/386 |

FOREIGN PATENT DOCUMENTS

| | | |
|---|---|---|
| 1273201 | 8/1990 | Canada . |
| 0167358 | 8/1986 | European Pat. Off. . |
| 0237356 | 9/1987 | European Pat. Off. . |
| 0289785 | 11/1988 | European Pat. Off. . |

*Primary Examiner*—Jacqueline V. Howard

*Attorney, Agent, or Firm*—David M. Shold; Forrest L. Collins; Frederick D. Hunter

[57] ABSTRACT

The present invention describes additives for fuels for use in diesel engines.

35 Claims, No Drawings

COMPOSITION AND METHOD RELATING TO DIESEL POWERED VEHICLES

This is divisional of copending application Ser. No. 07/619,849 filed on Nov. 29, 1990 now U.S. Pat. No. 5,197,997.

INTRODUCTION TO THE INVENTION

The present invention relates to diesel powered vehicles and in particular to alternative fuels for use in diesel powered vehicles.

It has recently become important for diesel powered vehicles to run on fuels other than petroleum derived feed stocks. At the present time, diesel fuels as later described, are obtained from hydrocarbons with minimal refining. Diesel engines are highly efficient in that they compress at a ratio usually twice as great as a normal internal combustion engine and thus effect a greater power conversion. Diesel fuels also typically are measured against cetane, the linear 16 carbon saturated compound for purposes of determining the efficiency of combustion. The cetane rating system is analogous to the octane rating system for gasoline powered internal combustion vehicles.

It is known that it is possible to utilize alcohols of high molecular weight as a total or partial replacement for a hydrocarbon based diesel fuel. Relatively recently, it has become possible to utilize short chain alcohols in diesel engines. The short chain alcohols are not necessarily considered to be petroleum derived. In particular, methanol may be obtained from methane but would not necessarily be considered as a petroleum derived alcohol. Stated otherwise, utilizing methane to obtain methanol is not the same as methanol obtained as a by-product of a cracking process. The distinction is heightened because many oil wells produce hydrocarbons and methane. The methane is often flared off at the well head because it is in an impure mixture not sufficiently valuable to process into its respective components. The present invention provides an outlet for impure gases which may be converted to alcohols for use in diesel vehicles.

A particular difficulty in utilizing alcohols in diesel engines relates to the blocking of injection ports in the diesel engine. It has not been determined if the deposits are a result of the alcohols used or caused by the diesel engine being switched between alcohol and normal diesel fuel. What is known is that it is beneficial to lubricate the fuel lines in a diesel engine and also to minimize or prevent corrosion resulting from the use of alcohols.

The use of alcohols modified with alkylene oxides in fuels is known from Alburger in U.S. Pat. Reissue No. 28,605 granted Nov. 4, 1975 which is based upon U.S. Pat. No. 3,311,479 issued Mar. 28, 1967. A further use of alkylene oxide condensates of short chain alcohols is found in U.S. Pat. No. 4,956,107 to Gutierrez et al issued Sep. 11, 1990.

Ericson et al in U.S. Pat. No. 4,925,581 issued May 15, 1990 describes the use of alkylene oxide condensates of alcohols. Similarly, Lewis in U.S. Pat. No. 4,198,306 issued Apr. 15, 1990 describes the use of alkylene condensates of alcohols. A further disclosure of the use of the alkylene oxide condensates of alcohols is found in U.S. Pat. No. 3,896,664 also to Alburger issued Jul. 29, 1975. The use of tartarimides is disclosed in U.S. Pat. No. 4,237,022 issued Dec. 2, 1980 to Daniel E. Barter.

The present invention as previously noted deals with cleaning of injection ports, lubricating a fuel line system in a diesel vehicle, and with minimizing corrosion in the fuel line system. The present invention also deals with obtaining stable compositions with regard to dispersion or solution of the additive components in an alcohol based diesel fuel.

Throughout the specification and claims percentages and ratios are by weight, temperatures are in degrees Celsius, and pressures are given in KPa gauge unless otherwise indicated. Ranges and ratios given herein may be combined. To the extent that any references cited herein are applicable to the present invention they are herein incorporated by reference.

SUMMARY OF THE INVENTION

The present invention describes a fuel additive comprising:

(A) an alkylene oxide condensate or the reaction product thereof and an alcohol, and a member selected from the group consisting of:

(B) a monocarboxylic fatty acid;

(C) the reaction product of a hydrocarbyl substituted amine and formaldehyde;

(D) a hydrocarbyl amine, or the reaction product thereof and an alkylene oxide, and, mixtures of B, C and D.

Still a further aspect of the present invention is a fuel additive comprising:

(A) an alkylene oxide condensate or the reaction product thereof and an alcohol, (B) a monocarboxylic fatty acid, and;

(C) the reaction product of a hydrocarbyl substituted amine and formaldehyde.

The present invention also contemplates a fuel additive comprising:

(A) an alkylene oxide condensate or the reaction product thereof and an alcohol, and a member selected from the group consisting of:

(C) the reaction product of a hydrocarbyl substituted amine and formaldehyde;

(D) a hydrocarbyl amine, or the reaction product thereof and an alkylene oxide, and;

(E) a hydrocarbyl substituted dicarboxylic acid.

Yet one more embodiment of this invention is a fuel additive comprising:

(A) an alkylene oxide condensate or the reaction product thereof and an alcohol, and a member selected from the group consisting of:

(B) a monocarboxylic fatty acid, and (C) a reaction product of a hydrocarbyl substituted amine and formaldehyde, and;

(D) a hydrocarbyl amine, or the reaction product thereof and an alkylene oxide.

A further version of the invention is a fuel additive comprising:

(B) a monocarboxylic fatty acid, and;

(C) the reaction product of a hydrocarbyl substituted amine, or the reaction product thereof and an alkylene oxide, and;

(D) a hydrocarbyl amine, or the reaction product thereof and an alkylene oxide, and;

(E) a hydrocarbyl substituted dicarboxylic acid.

Yet a further embodiment of the present invention is a fuel additive comprising:

(A) an alkylene oxide condensate or the reaction product thereof and an alcohol, and a member selected from the group consisting of:

(B) a monocarboxylic fatty acid; and,
(D) a hydrocarbyl amine, or the reaction product thereof and an alkylene oxide.

Another version of the present invention is a fuel additive comprising:
(A) an alkylene oxide condensate or the reaction product thereof and an alcohol, and a member selected from the group consisting of:
(B) a monocarboxylic fatty acid; and,
(C) a reaction product of a hydrocarbyl substituted amine, or the reaction product thereof and an alkylene oxide, and;
(D) a hydrocarbyl amine, or the reaction product thereof and an alkylene oxide, and;
(E) a hydrocarbyl substituted dicarboxylic acid.

The present invention also describes a method of treating a fuel including the steps of combining the fuel with a composition comprising at least three of the following components:
(A) an alkylene oxide condensate or the reaction product thereof and an alcohol, and a member selected from the group consisting of:
(B) a monounsaturated fatty acid; and,
(C) a reaction product of a hydrocarbyl substituted amine and formaldehyde, and;
(D) a hydrocarbyl amine, or the reaction product thereof and an alkylene oxide, and,
(E) a hydrocarbyl substituted dicarboxylic acid.

DETAILED DESCRIPTION OF THE INVENTION

The present invention utilizes one or more of the following components which are designed to provide lubricity, cleaning properties, enhance the stability of a dispersion or solution of the components in an alcohol, and to otherwise aid in the combustion process of an alcohol based diesel fuel.

COMPONENT (A)

Component (A) is described as the reaction product of an alcohol and an alkylene oxide. The alcohols are typically those containing from 1 to 20 carbon atoms, preferably 1 to 10 carbon atoms, and most preferably 2 to 4 carbon atoms. The alcohol may be monohydric or polyhydric preferably the former. The alcohol is also typically a linear alcohol, although branched alcohols may be utilized as well. A preferred short chain alcohol for the reaction product with a lower alkylene oxide is butanol.

The alkylene oxides of particular interest in the present invention contain from 2 to 6 carbon atoms. Typically, the preferred alkylene oxides contain from 2 to 4 carbon atoms between the oxygen molecules. Preferably, the alkylene oxide is ethylene or propylene oxide, or mixtures thereof.

The proportion of the alkylene oxide to the short chain alcohol is typically from 1 to 50, preferably 10 to 50 moles of the alkylene oxide per mole of the alcohol. It is also preferred that the reaction product of the alcohol and the alkylene oxide be obtained such that there is a free hydroxyl group on the reaction product. Stated otherwise, the alcohol should not cap both ends of the alkylene oxide.

The molar ratio of ethylene oxide to propylene oxide when a mixture is employed is typically from 10:1 to 1:10, preferably from 6:1 to 1:6.

A preferred source of component (A) is from the Union Carbide Company and is identified as Ucon LB 625 which is the reaction product of n-butanol and a ethylene and propylene oxide mixture. The molecular weight of the Ucon LB 625 is approximately 1,700.

COMPONENT (B)

The second component of the present invention is a monocarboxylic fatty acid. Typically, the monocarboxylic acid will contain from 12 to 24 carbon atoms. More preferably, the fatty acid contains from 12 to 20 carbon atoms and most preferably contains 16 or 18 carbon atoms. Of course, mixtures of fatty acids may be utilized in the present invention. Preferably, the monocarboxylic acid for use in the present invention is oleic acid. The location of the unsaturation in the monounsaturated fatty acid is not particularly important, however, it is preferred that it be centrally located in the unsaturated acid. The use of the term fatty in describing the monounsaturated acid is merely related to its most likely source which is the hydrolysis of a triglyceride, e.g. fat. However, monocarboxylic acids from any source are suitable for use in the present invention. Also within the contemplation of the present invention is the use of mixtures of monocarboxylic acids, and further include the use of impure mixtures of monocarboxylic fatty acids, e.g. such as those mixtures of unsaturated, polyunsaturated and saturated fatty acids.

COMPONENT (C)

The third component for use in the present invention is described as a hydrocarbyl substituted amine reacted with formaldehyde. It is first noted that component (C) may conveniently be obtained as the described reaction product. However, the present invention contemplates any method of obtaining the foregoing material and thus it is not necessary that the compound be obtained from a specific reaction. Typically, the hydrocarbyl portion of the molecule from the hydrocarbyl substituted amine reacted with the formaldehyde will contain from 12 to 24 carbon atoms in the hydrocarbyl group. Preferably, the hydrocarbyl portion of component (C) contains from 16 to 20 carbon atoms in the hydrocarbyl group.

It is noted at this point that when the term hydrocarbyl is utilized herein that is includes all manner of branched, linear, saturated and unsaturated organic compounds. The term hydrocarbyl also includes other nonorganic components including oxygen, sulfur, chlorine and the like with the proviso that any additional hetero atoms should not materially interfere with the purpose of the invention.

The hydrocarbyl substituted amine utilized in component (C) is typically a dinitrogen containing amine. That is, there are two amine functional groups in the precursor molecule. However, it is entirely possible that amine functionality will cross-link in the product due to the presence of the aidehyde. That is, it is possible that two moles of tallow diamine will react giving repeating units derived from the hydrocarbyl substituted amine.

The hydrocarbyl substituted amine as utilized in the present invention is preferably a saturated or monounsaturated fatty primary amine with a secondary amine nitrogen in the molecule. The reaction product will preferably be such that there is no remaining primary or secondary amine in any substantial amount remaining in component (C).

A preferred source of the hydrocarbyl substituted amine in component (C) is obtained from natural fats and in particular tallow amine is utilized. Of course, any particular source of the amine falling within the general description given above is suitable as the hydrocarbyl substituted amine.

The aldehyde chosen as useful in the present invention in the manufacture of component (C) is formaldehyde. Of course, other aldehydes may be utilized, however, formaldehyde if the most common material and the addition of carbon atoms from a material such as acetaldehyde do not impart any particular benefit over formaldehyde. The formaldehyde may be obtained as a solid, as paraformaldehyde, alcoholic or aqueous mixture of the formaldehyde.

The manner of obtaining component (C) is by any convenient reaction to condense the hydrocarbyl substituted amine with formaldehyde. While the term condensation is utilized herein any particular reaction to give a material falling within the scope of component (C) may be employed. Typically, the components are mixed together in the requisite quantities and are reacted at a temperature between the solidification point of the lowest melting solid and the decomposition temperature of the lowest decomposing component. Generally stated, the reaction of the hydrocarbyl substituted amine with the formaldehyde to obtain component (C) is between 50° C. and 150° C. If desired a catalyst may be utilized in the foregoing reaction and such a catalyst is caustic. Water is a by-product of this reaction.

The ratio of the aldehyde to the amine in the present invention is based typically on from 1 to 2 moles of the primary amine per 0.25 to 5 moles of the aldehyde.

COMPONENT (D)

The present invention contemplates the use of a hydrocarbyl amine or the reaction product thereof and an alkylene oxide. The hydrocarbyl oxyalkylated amine typically contains from 8 to 24 carbon atoms in the hydrocarbyl portion of the molecule. The foregoing provisos with regard to component (C) as to the definition of a hydrocarbyl group are also applicable to component (D).

Preferably the hydrocarbyl group in the hydrocarbyl amine contains from 12 to 18 carbon atoms and is preferably a saturated material. In particular, a C13 or C14 hydrocarbyl group is preferred.

A suggested structural formula for the hydrocarbyl oxyalkylated amine of the present invention is $R^1OR^2NH_2$ wherein $R^2$ is a divalent alkylene radical having from 2 to 6 carbon atoms and $R^1$ is a hydrocarbyl radical as described above. Component (D) is then preferably a primary ether amine which is obtained from the reaction of an alcohol $R^1OH$ with an unsaturated nitrile. The radical $R^1$ of the alcohol may be hydrocarbon based or may be an aliphatic or aromatic based radical.

As previously noted the alcohol portion of the molecule may be from a linear or branched aliphatic alcohol. The nitrile reactant of component (D) may have from 2 to 6 carbon atoms with acrylonitrile being most preferred.

Typically, the components may be manufactured by simply reacting the foregoing components. Alternatively, it is possible to purchase such ether amines as component (D) is Seco P-17-B available from Sea Land Chemical Company. The preferred material is a branched tridecyl amine. A preferred material is tridecyl-3-aminopropyl ether.

The molecular weight of the preferred materials utilized in component (D) is typically about 150 to about 400. The preferred ether amines have a molecular weight of 220 to 300.

COMPONENT (E)

The hydrocarbyl substituted dicarboxylic acid is employed in the present invention in addition to component (B) which is a monounsaturated acid. Component (E) contains as a hydrocarbyl group materials typically containing from 12 to 30 carbon atoms in the hydrocarbyl group, typically from 12 to 18 carbon atoms. The foregoing provisos on hetero atoms within the hydrocarbyl group are also application to component (E).

The dicarboxylic portion of the hydrocarbyl substituted dicarboxylic acid (E) is typically obtained from maleic anhydride. While the carboxylic groups do not necessarily have to be in a configuration as when derived from maleic anhydride it is preferable that the molecule be so structured for solubility and effectiveness in end use.

The preparation of the preferred hydrocarbyl substituted dicarboxylic acid is described in U.S. Pat. No. 4,234,435 issued to Meinhardt and Davis which is herein incorporated by reference. Of course, as previously stated other dicarboxylic acids may be utilized in the present invention.

COMPONENT (F)

Component (F) is a diesel fuel which is hydrocarbon based. As previously noted diesel fuels are typically saturated mixtures of hydrocarbons containing from 14 to 18 carbon atoms. Diesel fuels are typically described by ASTM Standard D-975. While the primary uses of the present invention are not with the hydrocarbon based diesel fuel it is possible to blend in the diesel fuel as later described, or to alternate the use of the diesel fuel with an alcohol based product as described herein. The benefits observed in the present invention are substantially similar when used in a hydrocarbon diesel fuel, an alcohol based fuel, or a mixture of the two.

COMPONENT (G)

The next component to be discussed in the present invention is the lower alcohol utilized as a replacement for a hydrocarbon based diesel fuel. Typically, the lower alcohol utilized as a fuel will contain from 1 to 8 carbon atoms, preferably less than 5 carbon atoms. The lower alcohol is also preferably a saturated alcohol and also preferably a linear alcohol. The preferred alcohols for utilization in the present invention are methanol, ethanol and mixtures thereof.

COMPONENT (H)

The present invention also beneficially utilizes hydrocarbon solvents. The solvents function as carriers and a vehicle for mixing the diverse components of the present invention. Typically, the hydrocarbon solvent may be a diesel fuel as described under component (F), a higher molecular weight alcohol, or an aromatic compound such toluene, or xylene. Of the foregoing the preferred solvent is xylene.

COMPONENT (I)

Gasoline as described in ASTM Standard D-439 is also useful herein. Gasoline will typically be used with the alcohol (G) to impart flame color.

ADDITIONAL COMPONENTS

The fuel and additive composition of the present invention may contain all manner of conventional ingredients. Typically, diesel fuels contain dyes, fuel stabilizers, cetane improvers, stabilizers, dyes and the like. The additional components are blended at their ordinarily used level in either the alcohol or diesel fuel aspect of the present invention.

AMOUNTS OF THE COMPONENTS

Component (A) is typically utilized in mixture with the monounsaturated fatty acid component (B) in a 5:1 to 1:5; preferably 3:1 to 1:3 weight ratio.

Component (A) the reaction product of the alcohol and the lower alkylene oxide is preferably utilized in a relation to component (C) the reaction product of a hydrocarbyl substituted amine and formaldehyde at a weight ratio of 3:1 to 1:3; preferably about 2:1 to 1:2.

In a similar vein, component (A) is utilized in a weight ratio to (D) the hydrocarbyl amine or the reaction product thereof and an alkylene oxide in a weight ratio of about 5:1 to about 1:5; preferably about 3:1 to about 1:1.

Component (A) when utilized in combination with component (E) the hydrocarbyl substituted dicarboxylic acid is used in a respective weight ratio of about 5:1 to about 1:5; preferably about 2:1 to about 1:2.

Component (B) the monounsaturated fatty acid is typically utilized in a weight ratio to component (C) the reaction product of the hydrocarbyl substituted amine and formaldehyde of about 5:1 to about 1:5; preferably 1:1 to about 1:3. Component (B) is also often utilized to component (D) the hydrocarbyl amine or the reaction product thereof and an alkylene oxide in a weight ratio of about 5:1 to about 1:5; preferably about 2:1 to about 1:2.

Where component (B) the monounsaturated fatty acid is combined with component (E) the hydrocarbyl substituted dicarboxylic acid the weight ratio of the ingredients respectively is about 5:1 to about 1:5; preferably about 1:1 to about 1:2.

Component (C) the reaction product of the hydrocarbyl substituted amine and formaldehyde when combined with component (D) the hydrocarbyl amine or the reaction product thereof and an alkylene oxide it is typically in a respective weight ratio of about 5:1 to about 1:5; preferably about 2:1 to about 1:1. Component (C) when combined with the hydrocarbyl substituted dicarboxylic acid (E) is typically so utilized at a respective weight ratio of about 5:1 to about 1:5; preferably about 2:1 to about 1:2.

Component (D) the hydrocarbyl amine or the reaction product thereof and an alkylene oxide is typically utilized when in combination with component (E) the hydrocarbyl substituted dicarboxylic acid at respective weight ratio of about 5:1 to about 1:5; preferably to about 2:1 to about 1:2.

The level of any of components (A) through (E) are at about 10 to about 300 ppm; preferably about 30 to about 150 ppm.

Component (H) the solvent is typically utilized at a weight ratio of 10:1 to 1:10, preferably about 5:1 to 1:2 for any of (A) through (E). Component (I) the gasoline is used at a 25:1 to 1:100 weight ratio to (G) the alcohol where Component (I) is employed.

The levels of the foregoing components as utilized may be determined by combining the ratios previously given for the components when more than two of the specifically mentioned components (A) through (E) are employed in the additive mixture. Most preferably, the mixture of components (A) through (E) are utilized at 200 to about 1,500 ppm, preferably about 300 to 750 ppm.

PREPARATION OF THE ADDITIVE MIXTURE

The components of the present invention are typically prepared in the presence of the solvent component (H). The ingredients are mixed at any convenient temperature between that at which the lowest component is a solid, if such is not soluble in the remaining components, up to the decomposition temperature of the lowest decomposing component present. Typically, the components may be blended in any order at a temperature from 5° C. to 100° C., preferably 5° C. to 50° C. As the components are flammable it is preferred that the mixing area be well ventilated and that open flames be avoided.

What follows is an example of the present invention.

EXAMPLE I

To 3.0 kg of xylene (H) is added 1.5 kg of oleic acid (B). After these components are thoroughly mixed at room temperature (20° C.) 2.6 kg of the hydrocarbyl amine (tallow amine) reacted with at least 3 moles of formaldehyde (C) is added and the mixing continued. Component D at 1.9 kg is added to the mixture slowly with stirring and cooling. Then 2.55 kg of component (E) the hydrocarbyl substituted dicarboxylic acid from U.S. Pat. No. 4,234,435 is added with stirring. Finally, 3.45 kg of component (A) butyl alcohol reacted with about 5 moles each of ethylene and propylene oxide is added to the mixture. Stirring is continued until the solution is homogeneous.

EXAMPLE II

To 3.0 kg of component (H) is added 2.6 kg of component (C). The components are thoroughly mixed at room temperature (20° C). Component (D) from Example I at 1.9 kg is added and the solution thoroughly mixed. Component (E) is added at 4.05 kg followed by mixing. Finally, 3.45 kg of component (A) is added and the solution mixed until homogeneous.

EXAMPLE III

The composition of Example I is blended into methanol at 0.03% by weight. The methanol is then used to fuel a DDC V692 Detroit Diesel diesel engine. It is observed after 100 hundred hours that the fuel injectors are considerably less clogged than when the alcohol is used alone as the fuel.

EXAMPLE IV

A diesel fuel is run as in Example III using the fuel additive system of Example II at 0.03% by weight. Excellent fuel pump and fuel injector wear is observed.

EXAMPLE V

A mixed alcohol and gasoline fuel system (85:15 by weight) has added thereto the product of Example I at 0.03% by weight. Excellent fuel pump and fuel injector wear is observed.

What is claimed is:

1. A fuel additive composition comprising:

(A) an alkylene oxide condensate or the reaction product thereof and an alcohol;

(B) a monocarboxylic fatty acid; and (C) a hydrocarbyl amine, or the reaction product thereof and an alkylene oxide.

2. The composition of claim 1 wherein the alkylene oxide condensate or the reaction product thereof and an alcohol (A) is the reaction product of an alcohol and a lower alkylene oxide.

3. The composition of claim 2 wherein the alcohol in component (A) contains from 1 to 20 carbon atoms.

4. The composition of claim 2 wherein the alcohol in component (A) is a straight chain alcohol.

5. The composition of claim 2 wherein the alcohol in component (A) is butanol.

6. The composition of claim 2 wherein the lower alkylene oxide in component (A) contains from 2 to 6 carbon atoms.

7. The composition of claim 2 wherein the lower alkylene oxide in component (A) is ethylene oxide.

8. The composition of claim 2 wherein the lower alkylene oxide in component (A) is propylene oxide.

9. The composition of claim 2 wherein the lower alkylene oxide in component (A) is ethylene oxide and propylene oxide.

10. The composition of claim 1 wherein the monocarboxylic acid (B) is unsaturated.

11. The composition of claim 1 wherein the monocarboxylic acid (B) contains from 12 to 24 carbon atoms.

12. The composition of claim 10 wherein the monocarboxylic acid (B) is oleic acid.

13. The composition of claim 10 wherein the monocarboxylic acid (B) contains from 14 to 20 carbon atoms.

14. The composition of claim 1 wherein the hydrocarbyl group in (D) contains from 8 to 24 carbon atoms.

15. The composition of claim 1 wherein the hydrocarbyl group in (D) is saturated.

16. The composition of claim 1 wherein the alkylene oxide in (D) contains from 2 to 4 carbon atoms per alkylene oxide unit.

17. The composition of claim 1 wherein the hydrocarbyl amine (D) is an oxypropylamine.

18. The composition of claim 1 additionally containing a hydrocarbon solvent.

19. The composition of claim 18 wherein the solvent is xylene.

20. The composition of claim 1 dispersed in a hydrocarbon fuel.

21. The composition of claim 20 wherein the hydrocarbon fuel is diesel fuel.

22. The composition of claim 20 wherein the hydrocarbon fuel is gasoline.

23. The composition of claim 1 and an alcohol.

24. The composition of claim 23 wherein the alcohol is selected from the group consisting methanol and ethanol.

25. The composition of claim 24 wherein the alcohol is methanol.

26. The composition of claim 25 wherein the monocarboxylic acid (B) is unsaturated.

27. The composition of claim 25 further including gasoline.

28. The composition of claim 1 additionally containing an alcohol selected from the group consisting methanol and ethanol.

29. The composition of claim 1 wherein the alcohol is methanol.

30. The composition of claim 28 additionally containing gasoline.

31. The composition of claim 1 additionally containing a hydrocarbon solvent.

32. The composition of claim 1 wherein the solvent is xylene.

33. The composition of claim 1 dispersed in a hydrocarbon fuel.

34. The composition of claim 33 wherein the hydrocarbon fuel is diesel fuel.

35. The composition of claim 33 wherein the hydrocarbon fuel is gasoline.

* * * * *